US006813463B2

(12) United States Patent
Kamiyama

(10) Patent No.: US 6,813,463 B2
(45) Date of Patent: Nov. 2, 2004

(54) BELT DEVICE AND IMAGE FORMING DEVICE USING THE SAME

(75) Inventor: Hideki Kamiyama, Yokohama (JP)

(73) Assignee: Ricoh Company Ltd., Tokyo (JP)

( * ) Notice: Subject to any disclaimer, the term of this patent is extended or adjusted under 35 U.S.C. 154(b) by 0 days.

(21) Appl. No.: 10/246,623

(22) Filed: Sep. 19, 2002

(65) Prior Publication Data

US 2003/0053827 A1 Mar. 20, 2003

(30) Foreign Application Priority Data

Sep. 20, 2001 (JP) ..... 2001-287021
Mar. 20, 2002 (JP) ..... 2002-078952

(51) Int. Cl.[7] ..... G03G 15/01; G03G 15/16
(52) U.S. Cl. ..... 399/302; 399/101
(58) Field of Search ..... 399/297, 302, 399/308, 313, 312, 101

(56) References Cited

U.S. PATENT DOCUMENTS 4,183,658 A * 1/1980 Winthaegen ..... 399/308
4,455,079 A * 6/1984 Miwa et al. ..... 399/308
5,442,428 A 8/1995 Takahashi et al.
5,701,566 A 12/1997 Bisaiji et al.
5,933,694 A * 8/1999 Yamashita et al.
6,057,869 A 5/2000 Kawaishi et al.
6,144,831 A * 11/2000 Takenouchi et al. ..... 399/302
6,321,052 B1 * 11/2001 Yamashina et al. ..... 399/308
6,353,721 B1 * 3/2002 Yamaguchi et al. ..... 399/302
6,501,925 B2 * 12/2002 Yamamoto et al.
2002/0048468 A1 * 4/2002 Sakaizawa et al.
2003/0099492 A1 * 5/2003 Maeyama et al. ..... 399/302

FOREIGN PATENT DOCUMENTS

JP 3-202884 9/1991
JP 2000-131899 5/2000
JP 2000-137386 5/2000
JP 2000137386 A * 5/2000 ..... G03G/15/14
JP 2001051522 A * 2/2001 ..... G03G/15/16
JP 2001-296755 10/2001

* cited by examiner

*Primary Examiner*—Susan Lee
(74) *Attorney, Agent, or Firm*—Oblon, Spivak, McClelland, Maier & Neustadt, P.C.

(57) ABSTRACT

An image forming device and a belt device therein are provided. Even though the perimeter of the intermediate transfer belt is changed, a good cleaning ability for the intermediate belt can be maintained. The toner image supporting surface of the intermediate transfer belt between the first and the secondary transfer devices is bent to the inner surface side by a bending member, and cleaned by a cleaning device. An opposite member is disposed at a position opposite to the cleaning device to sandwich the intermediate transfer belt. In this way, even though the position of the bending member is changed by the perimeter deviation of the intermediate transfer belt, the position for removing the residual toner to clean the intermediate transfer belt does not change, so as to maintain a good cleaning ability.

30 Claims, 11 Drawing Sheets

BELT DEVICE AND IMAGE FORMING DEVICE USING THE SAME

CROSS-REFERENCE TO RELATED APPLICATION

This application claims the priority benefit of Japanese application serial no. 2001-287021, filed on Sep. 20, 2001, and 2002-078952, filed on Mar. 20, 2002.

BACKGROUND OF THE INVENTION

1. Field of the Invention

This invention relates in general to an image forming device, such as a copying machine, a printer, or a facsimile. More particularly, the invention relates to a tandem type image forming device, wherein after a first transfer stage at which a toner images on plural image supporters disposed along an intermediate transfer belt are sequentially composed on the intermediate transfer belt at a first transfer section where the intermediate transfer belt and each image supporter are oppositely arranged, the composite toner image transferred on the intermediate transfer belt is collectively transferred on a transfer material at a secondary transfer section where the intermediate transfer belt and the transfer material are oppositely arranged.

2. Description of Related Art

As described above, the tandem-type image forming device has the following advantages. A large amount of color documents were handled and this would continue in increasing volume for many more years, and therefore, demands for a compact and high-speed image forming device, such as a full color printer and a full color copying machine, etc. is highly desirable For the color image forming device, in general there are two types, namely, a one drum type image forming device and a tandem type image forming device. The color image forming device of one drum type comprises a plurality of developing units disposed around one photoreceptor (the image supporter) for forming toner images in different colors. Thereafter, a composite toner image is formed on the photoreceptor by using the developing units, and then the composite toner image on the photoreceptor is transferred onto a recording medium, such as a paper or an OHP sheet, to form a color image. On the other hand, tandem-type color image forming device comprises a plurality of image forming units each of which includes a photoreceptor and an image forming means. The single-color toner image for each color is respectively formed on each image forming unit. These single-color toner images are overlapped and transferred onto a recording medium transported by a transferring/transporting belt, or onto an intermediate transfer belt, so as to form a composite color image.

The one drum image forming device can be more compact since one photoreceptor is included, and advantageously, the cost can be reduced. However, because one photoreceptor is usedperform for several times (usually, 4 times) of image forming processes to form a full color image, therefore the image formation with a high speed is very difficult. In contrast, the tandem-type image forming device has drawbacks in being large in size and high cost, but has advantages in the image formation with a high speed. Recently, since the need for a high speed or a faster and full color forming device is highly demanded, skilled people pay more attention on the above tandem-type image forming device.

For the tandem-type image forming device, there are a direct transfer type and an indirect transfer type. The tandem-type image forming device of direct transfer type transfers sequentially the image on the photoreceptor of each image forming unit onto the recording medium that is transported by the transferring/transporting belt. On the other hand, for the tandem-type image forming device of indirect transfer type, a first transfer stage is first performed so that the image on the photoreceptor of each image forming unit is sequentially overlapped onto the intermediate transfer belt. Next, the secondary transfer stage is performed so that the first transferred image on the intermediate transfer belt is wholly transferred onto the recording medium.

Referring to FIGS. 17 and 18, generally, in the tandem-type image forming device of direct transfer type, each of the image forming units is disposed side by side in the horizontal direction along the transferring/transporting belt. In this way, the paper feeding device for feeding the recording medium is disposed at the upmost upstream side of the transferring/transporting belt. Therefore, the perimeter of the horizontal portion where the recording medium on the transferring/transporting belt is transported gets longer, but however such a image forming device has a drawback, in that the device main body gets larger along the horizontal direction.

In order to prevent the device main body from becoming large along the horizontal direction, it is necessary that the fixing device has to be disposed in the vicinity of a separating section at which the recording medium where the composite toner image is transferred thereon is separated from the transferring/transporting belt. However, in such a configuration, it is very difficult to maintain a sufficient gap at which the recording medium that is separated from the transferring/transporting belt possesses a margin to bend between the separating section and the fixing device.

Therefore, in the above structure where the separating section and the fixing device are formed nearby, it is easy that the transferred image is adversely affected by an impact when the tip of the recording medium enters the fixing device (the thicker the recording medium is, the larger the impact is), or by a speed difference between the fixing device's transporting speed and the transferring/transporting belt's transporting speed. In contrast, in the tandem-type image forming device of intermediate transfer type, the position of the secondary transfer device can be more freely selected. Therefore, in the tandem-type image forming device of intermediate transfer type, the paper-feeding device and the fixing device can be disposed under the intermediate transfer belt, and advantageously, the device main body can be more compact along the horizontal direction. In addition, the device can maintain a sufficient gap at which the recording medium that is separated from the intermediate transfer belt can be bent between the fixing device and the separating section of the intermediate transfer belt. As described, since the tandem-type image forming device of intermediate transfer type possesses a margin capable of disposing the fixing device, it almost has no influence on the image formation of fixing device. For reasons as described above, skilled people in the field have paid much attention on the tandem-type image forming device of intermediate transfer type.

In the aforementioned image forming device, after the composite toner image on the intermediate transfer belt 10 of the secondary transfer device is collectively transferred on the transfer S, it is necessary to exactly separate the transfer paper S from the intermediate transfer belt 10 at the separating section. The separating ability of the transfer paper S at the separating section is also affected by the material of the intermediate transfer belt 10 and the entrance angle of the recording medium (the transfer paper S), but is largely affected by the winding angle θ with respect to the supporting roller 16 of the intermediate transfer belt 10 at the separating section. If the intermediate transfer belt 10's the winding angle θ with respect to the supporting roller 16 forming the separating section is small, the separating ability of the transfer paper S at the separating section gets worse. In the worst situation, the transfer paper is not separated at the separating section, and then is transported and gets wounded on the intermediate transfer belt 10. Therefore, for the image forming device using the intermediate transfer belt 10, it is necessary to form a separating charger or a separating claw in order to separate the transfer paper S smoothly at the separating section according to the conventional art.

In order to improve the separating ability of the transfer material at the separating section of the intermediate transfer belt, the present inventor provides an image forming device (as shown in Japanese Laid Open No. 08-146706) with a structure that the toner image supporting surface of the intermediate transfer belt between the first transfer device and the secondary transfer device is bent by a bending member to the inner surface side of the intermediate transfer belt.

According to the above image forming device, since the toner image supporting surface of the intermediate transfer belt is bent by a bending member to the inner surface side of the intermediate transfer belt, a sufficient winding angle of the intermediate transfer belt with respect to the separating roller can be obtained. Therefore, in the image forming device, the transfer material at the separating section of the intermediate transfer belt can be smoothly separated, and the separating charger or the separating claw to help the curvature separation for the transfer material is not necessary.

On the other hand, in the tandem-type image forming device of intermediate transfer type using the intermediate transfer belt, when the composite toner image is transferred to the transfer material at the secondary transfer device, a portion of toner of the composite toner image is not transferred to the transfer material and then is residual on the intermediate transfer belt. After the secondary transfer stage, in order to avoid influence on the next image formation, the residual toner on the intermediate transfer belt has to be removed from the intermediate belt at least before reaching the first transfer device.

In image forming device disclosed in Japanese Laid Open No. 2000-137386, a cleaning device for removing the residual toner on the intermediate transfer belt after the secondary transfer is disposed at the downstream side of the secondary transfer device and at the upstream side of the pressing member (used as the above bending member). In general, the cleaning blade or the cleaning brush is used as most of the cleaning devices.

FIG. 19 shows an image forming device disclosed in Japanese Laid Open No. 2000-137386. The image forming device comprises a driving roller 14, driven rollers 15, 16, an intermediate transfer belt (belt, hereinafter) 10 and a bending roller 150. Referring to FIG. 19, since a portion of the outer surface of the belt 10 is bent by the bending roller 150, the space occupied by the belt device is reduced. Therefore, the degree of freedom of the machine layout disposed in the vicinity of the belt device is increased. For example, referring to FIG. 14, the portion of the belt device, which is bent by the bending member, can be used for arranging the fixing device 25, so that the image forming device can become more compact.

Additionally, in the image forming device shown in FIG. 19, four image forming units 18 are arranged along the belt outer surface of the intermediate transfer belt 10. Each image forming device 18 comprises a photoreceptor 40 (used as the image supporter) and an image forming means for forming a toner image on the photoreceptor 40. The image forming means comprises a charging roller 60, an exposure device 21, a developing device 67 and a photoreceptor cleaning device 63, etc.

In FIG. 19, the toner images for colors, such as cyan, magenta, yellow and black are respectively formed on each photoreceptor 40. The toner image of each color formed on the photoreceptor 40 is sequentially transferred to be overlapped on the intermediate transfer belt 10 by the first transfer rollers 62 that are disposed opposite to the photoreceptors 40. In this way, a full color composite toner image is formed on the intermediate transfer belt 10. The composite toner image formed on the intermediate transfer belt is then transferred onto the transfer paper S in a secondary transfer stage by a secondary transfer roller 23 that is disposed opposite to the outer surface of belt 10 stretched by the supporting roller 16. After the transfer paper S is separated from the belt 10 and then sent to the fixing device 25, the composite toner image that is transferred on the transfer paper S is fixed on the transfer paper S. On the other hand, the residual toner, which is not transferred onto the transfer paper S in the secondary transfer stage and is residual on the intermediate transfer belt 10, is further removed from the intermediate transfer belt 10 by the belt cleaning device 17 disposed at the secondary transfer device's downstream side in the belt's rotational direction. The belt cleaning device 17 is used to remove the residual toner on the intermediate transfer belt 10 by a cleaning blade 17*a* that is in contact with the belt 10's outer surface. In addition, the belt cleaning device 17 is disposed at the bending roller 150's upstream side in the belt's rotational direction. In this way, the residual toner on the belt can be prevented from being adhered on the bending roller 150.

However, in the tandem-type image forming device of intermediate transfer type using the above intermediate transfer belt, unevenness of the perimeter of the intermediate transfer belt is created after a long time use. For example, when the initial perimeter of the intermediate transfer belt is 950 mm (23° C.), the belt perimeter itself has a tolerance of about ±2 mm. In addition, due to the use environment (10° C.~32° C.), a contraction and expansion amount of about ±2 mm can be foreseen. Furthermore, the belt's the expansion amount of about 2~3 mm after a long time use can be also predicted. As a result, a prediction of a maximum perimeter deviation of about 10 mm is necessary.

Therefore, in the above image forming device, due to the perimeter deviation of the intermediate transfer belt, the position of the bending member that presses the intermediate transfer belt becomes a barrack. For example, when the initial perimeter of the intermediate transfer belt is 950 mm (23° C.), if the belt perimeter has a variation of 10 mm, the bending member moves by 7 mm.

Therefore, in the image forming device disclosed in Japanese Laid Open No. 2000-137386, when no other elements are disposed at a position opposite to the cleaning device, due to the variation of the belt perimeter of the intermediate transfer belt, the position of the pressing member (used as the bending member) is changed, and a deviation in the position relationship between the cleaning device and the intermediate transfer belt is created. The cleaning ability of the cleaning device for the residual toner gets worse.

Namely, in the image forming device, when the belt perimeter of the intermediate transfer belt is stretched, the position of the pressing member might be changed in a direction where the intermediate transfer belt and the cleaning device are separated. As described above, as the position of the pressing member might be changed in a direction where the intermediate transfer belt and the cleaning device are separated, the contact angle and the engaging amount between the cleaning device and the intermediate transfer belt are reduced.

In addition, in the above bending device, in order to stabilize the first transfer stage for transferring the toner image onto the intermediate transfer belt 10, the driving roller 14 is disposed at the downstream side of the first transfer device in the belt's rotational direction, in general. Namely, the driving roller 14 is disposed at the downstream side of the first transfer device in the belt's rotational direction, and therefore, the belt portion corresponding to the first transfer device becomes stretched side of the belt, so that the toner image transferred to the intermediate transfer belt in the first transfer stage can be stabilized. However, in this belt device, the belt portion corresponding to the secondary transfer device becomes a loose side. Therefore, to transfer the composite toner image onto the transfer paper might be unstable. One of the method to solve this issue is to make the bending roller 150 to possess function as a belt tension member, so as to provide a tension against the belt outer surface that is at the secondary transfer device's downstream side in the belt's rotational direction.

As the bending roller 150 is displaced due to the perimeter variation of the belt 10, for example, as shown in FIG. 14, a deviation in the position relationship between the cleaning blade 17*a* and the belt outer surface is created. This position deviation causes the reduction of the cleaning blade 17*a*'s cleaning ability and the belt device's life time. Namely, when the intermediate transfer belt 10 is deviated by the bending roller 150's displacement in a direction where the belt 10 is separated from the cleaning blade 17*a*, the contact angle and the engaging amount between the belt 10 and the cleaning blade 17*a* are reduced. Therefore, in this situation, the cleaning ability for the residual toner on the belt 10 is reduced. On the other hand, when the intermediate transfer belt 10 is deviated by the bending roller 150's displacement in a direction where the belt 10 is close to the cleaning blade 17*a*, the contact pressure between the belt 10 and the cleaning blade 17*a* increases. Therefore, in this situation, the wear of the belt outer surface is quick and the loading of the belt 10 during its rotation is increased, so that the life time of the belt device is reduced.

Furthermore, the position deviation of the belt does not only relate to the cleaning blade 17*a*. When the aforementioned position deviation occurs on the belt, somewhat adverse effect might impart on the acting member that provides certain action against the belt outer surface even though in the status that the predetermined position relationship with respect to the belt's outer surface at the upstream side of the bending roller 150. For example, when the acting member is a coating member for coating a lubricant such as the zinc stearate etc on the belt outer surface, if the contact condition between the coating member and the belt outer surface is changed due to the belt's position deviation, the lubricant cannot be uniformly coated on the belt outer surface. The other members that will be adversely affected by the belt's position deviation are the charging device for charging the belt's outer surface, the exposure device for exposing the belt's outer surface, for example.

In addition, in the above description, the belt's position deviation is created by the displacement of the bending roller 150. However, the position deviation can be also created by that belt is loosened by the driving roller 14 when the belt is driven to rotate. Therefore, in the belt device where the above bending roller 150 is disposed at the position corresponding to the belt loose side, even though the bending roller 150 does not displace, the loose belt might cause adverse effect on the other members.

In addition, in the above description, it states that the position deviation of the intermediate transfer belt 10 affect adversely on the acting members. However, this problem is limited to the above situation. For example, when the belt is the photoreceptor belt, if the deviation in the position relationship between the exposure device (used as the acting member) and the photoreceptor belt is created, to form a good latent image is damaged. In addition, when the belt is the paper transporting belt for transporting the transfer paper, if the deviation in the position relationship between the charging device (used as the acting member) and the paper transporting belt is created, the electrostatic adhesion of the transfer paper to the paper transporting belt is unstable. Furthermore, when the belt is the fixing belt for fixing the toner image on the transfer paper, if the deviation in the position relationship between the releasing-oil coating device (used as the acting member) and the fixing belt is created, unevenness in coating the oil onto the fixing belt might occur.

SUMMARY OF THE INVENTION

In light of the foregoing problems, it is an object of this invention to provide an image forming device, wherein even though the perimeter of the intermediate transfer belt is changed, a good cleaning ability for the intermediate transfer belt can be maintained.

It is another object of this invention to provide a belt device, wherein even though a position deviation of the belt occurs, the position relationship between the acting member and the belt outer surface can be maintained.

It is still another object of this invention to provide an image forming device using the above belt device to perform the image forming process.

According to the objects mentioned above, the invention provides an image forming device. The image forming device comprises an endless intermediate transfer belt, stretched by a plurality of rollers; a plurality of image supporters, disposed at positions opposite to the endless intermediate transfer belt; a plurality of image forming units, for forming toner images respectively on each of the image supporters; a first transfer device, for performing a first transfer stage, wherein each toner image formed on each image supporter is sequentially composed on the endless intermediate transfer belt at a first transfer section where the endless intermediate transfer belt and the image supporters are oppositely arranged; a secondary transfer device, for performing a secondary transfer stage, wherein a composite toner image transferred on the endless intermediate transfer belt at a secondary transfer section where the endless intermediate transfer belt and a transfer material are oppositely arranged; a bending member, for bending a toner image supporting surface of the endless intermediate transfer belt between the first transfer section and the secondary transfer section towards an inner surface side of the endless intermediate transfer belt; a cleaning device, disposed between the bending member and the secondary transfer section, for cleaning up the toner image supporting surface of the endless intermediate transfer belt; and an opposite member, disposed at a position opposite to the cleaning device to sandwich the endless intermediate transfer belt, and in contact with the inner surface of the endless intermediate transfer belt.

In the above image forming device, by using the opposite member, the toner image supporting surface of the intermediate transfer belt is regularly in contact with the cleaning device disposed between the bending member and the secondary transfer device. In this way, even though the position of the bending member is changed by the expansion or the contraction of the intermediate transfer belt, the deviation in the position relationship between the intermediate transfer belt and the cleaning device does not occur. Therefore, in the image forming device, the contact angle and the engaging amount between the cleaning device and the intermediate transfer belt can be more stable and a good cleaning ability for the intermediate transfer belt can be maintained.

The opposite member is disposed in a manner that the inner surface of the endless intermediate transfer belt is bent to the outer surface side of the endless intermediate transfer belt. In the above image forming device, by using the opposite member, the inner surface of the intermediate transfer belt is bent to the outer surface side of the intermediate transfer belt. In this way, the contact angle and the engaging amount between the cleaning device and the intermediate transfer belt can be more stable and a good cleaning ability for the intermediate transfer belt can be maintained.

The bending member can be a tension member for providing a tension against the endless intermediate transfer belt by a displacement of the bending member. In the above image forming device, by using the tension member as the bending member to provide a tension against the intermediate transfer belt, the belt running ability of the intermediate transfer belt that is in contact with the cleaning device can be stabilized, and therefore, a good cleaning ability for the intermediate transfer belt can be maintained. The tension member can use a roller that is rotated and is in contact with the outer surface of the intermediate transfer belt. In this situation, the degradation of the outer surface of the intermediate transfer belt can be suppressed to minimum, so that the belt running ability of the intermediate transfer belt can be stable.

Furthermore, in a status that the perimeter is minimum, the tension member has a maximum displacement to an outer surface side of the endless intermediate transfer belt, the endless intermediate transfer belt has a perimeter where a contact portion with respect to the opposite member is bent to the outer surface side.

In the above image forming device, the perimeter of the intermediate transfer belt can be minimized because of its tolerance, the use environment and the long time use. Even though the tension member has a maximum displacement to the outer surface side of the intermediate transfer belt, the contact portion corresponding to the opposite member is bent to the outer surface side. Therefore, in the image forming device, even though the perimeter is changed by the expansion and the contraction of the intermediate transfer belt, the contact angle and the engaging amount between the cleaning device and the intermediate transfer belt can be regularly stable and a good cleaning ability for the intermediate transfer belt can be maintained.

The opposite member can be a roller that is rotated and is in contact with the inner surface of the endless intermediate transfer belt. In the image forming device, by using the roller as the opposite member, the degradation of the outer surface of the intermediate transfer belt can be suppressed to minimum, so that the belt running ability of the intermediate transfer belt can be stable.

The invention further provides a belt device. The belt device comprises an endless belt; a driving roller for driving the endless belt to rotate in a predetermined direction; a supporting roller, for supporting the belt at a position of a loose side of the belt that is driven by the driving roller to rotates; a bending member, located at a downstream side of the supporting roller in the belt's rotational direction, for bending an outer surface of the belt to an inner surface side of the belt; an acting member, disposed between the supporting roller and the bending member, maintaining a predetermined position relationship with respect to the outer surface of the belt to provide a predetermined action on the outer surface of the belt; and an opposite member, disposed at a position opposite to the acting member to sandwich the belt, and being in contact with the inner surface of the belt.

In the above belt device, since the belt inner surface is in contact with the opposite member, the position relationship between the acting member and the belt outer surface can be maintained. In this way, even though the bending member is displaced by the belt's expansion or contraction or the belt is loose at the beginning of driving the belt, the deviation in the position relationship between the acting member and the belt outer surface does not occur.

In the above belt device, the opposite member is in contact with inner surface of the belt, such that a winding angle of the belt with respect to the supporting roller is set at an angle capable of separating a sheet that is transported along the outer surface of the belt of the supporting roller's upstream side in the belt's rotational direction from the outer surface of the belt.

In addition, the belt device further comprises a belt tension applying member for providing a predetermined tension against the belt. The belt tension applying member is disposed at a position where the winding angle of the belt with respect to the supporting roller is not changed by utilizing a displacement of the belt tension applying member.

In the above belt device, the bending member also functions as the belt tension applying member. Alternatively, the acting member can be a cleaning device for cleaning the outer surface of the belt. The cleaning device can be a blade in contact with the outer surface of the belt. In addition, the cleaning device can also be a fur brush that is able to rotate and is in contact with the outer surface of the belt.

In the above belt device, the opposite member is disposed at a position to press the inner surface of the belt, even though the belt has a maximum contraction and the bending member displaces to the outer surface side of the belt.

In the above belt device, preferably, the bending member can be a roller, the opposite member can be a roller, and the belt tension applying member can be also a roller.

In the above belt device, the belt can be a transferring/transporting belt, for transporting a recording medium having an image recorded thereon, and for transferring the image, which is formed on an image supporter disposed along the outer surface of the belt, onto the recording medium.

In the above belt device, the belt can be an intermediate transfer belt. The image on the image supporter disposed along the outer surface of the belt is first transferred, and the first transferred image is transferred on the recording medium that is fed to opposite the outer surface of the belt.

The belt, the driving roller, the supporting roller, the bending member, and the belt tension applying member are integrally contained within a frame, wherein the frame is detachably installed at a predetermined position in an image forming device that is used to form an image on a recording medium.

In addition, the belt device further comprises a driving force transmitting device for transmitting a driving force form a driving source installed in a main body of the image forming device to the driving roller, as the frame is installed at the predetermined position in the image forming device.

The invention further provides an image forming device, which comprises at least one image supporter, for supporting an image; at least one image forming means, for forming the image on the image supporter; and a transferring device, having a belt device, wherein the belt device has an endless type belt, and the endless type belt is stretched by a plurality of rollers and is driven to rotate, and the belt device has a structure as described above.

In the above image forming device, the image means further comprises a plurality of developing device capable of sequentially overlapping toner images with different colors onto the image supporter. In addition, the image supporter and the image forming means forms one image forming unit, and a plurality of the image forming units are arranged along the endless type belt of the belt device.

BRIEF DESCRIPTION OF THE DRAWINGS

While the specification concludes with claims particularly pointing out and distinctly claiming the subject matter which is regarded as the invention, the objects and features of the invention and further objects, features and advantages thereof will be better understood from the following description taken in connection with the accompanying drawings in which:

DESCRIPTION OF THE PREFERRED EMBODIMENT

<<First Embodiment>>

Figure 1:
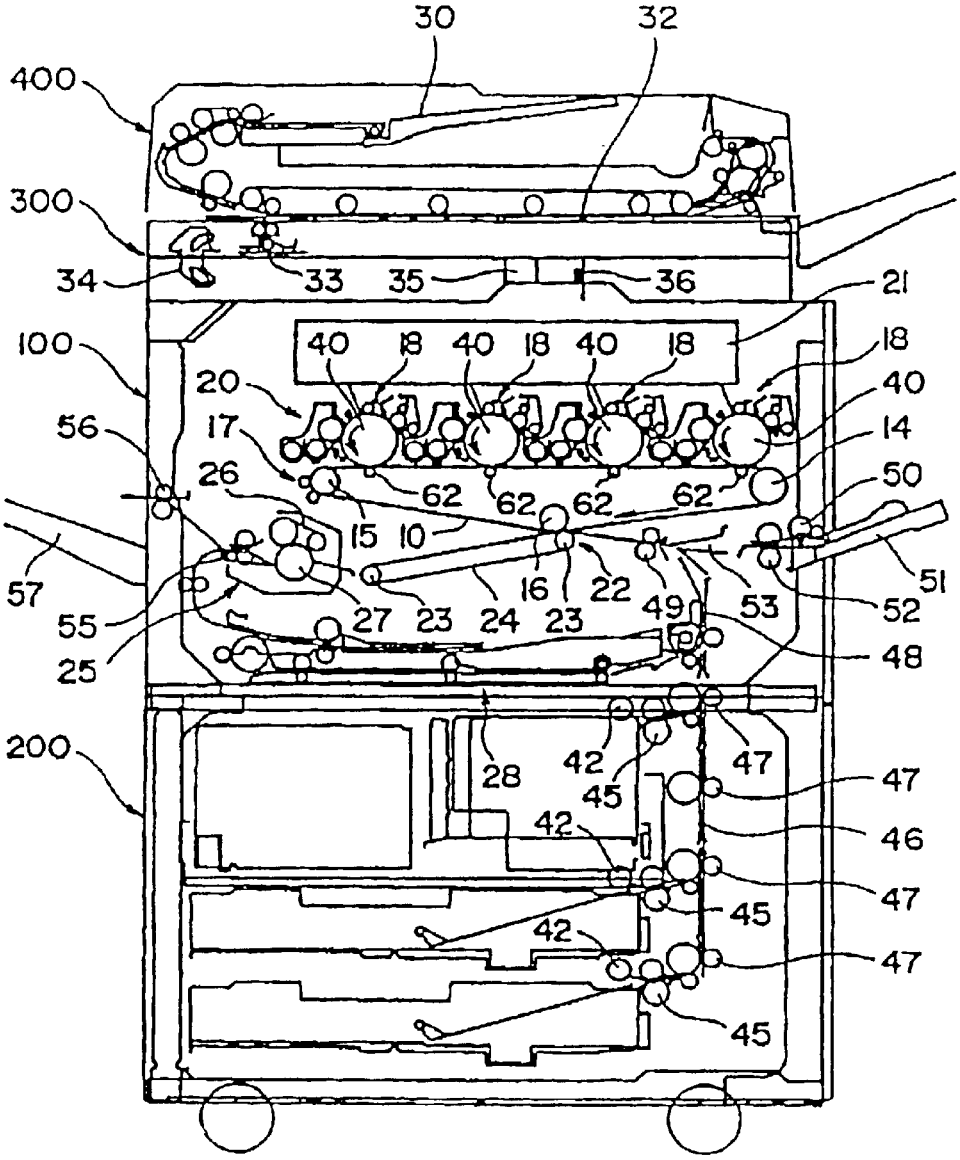
FIG. 1 is a schematic structure of a tandem-type image forming device according to the embodiment of the invention.

Following descriptions are preferred embodiments of a color electrophotographic copying machine according to the present invention. FIG. 1 schematically shows a tandem type structure of a color electrophotographic copying machine of indirect transfer manner. The color electrophotographic copying machine comprises mainly a copy device main body 100, a paper-feeding table 200 on which the copy device main body 100 is carried, a scanner 300 installed on the copy device main body 100, and an automatic document feeder (ADF) device 400 installed on the scanner 300.

In the copy device main body 100, an endless belt-shaped intermediate transfer belt 10 is disposed at the center. As shown in FIG. 1, the intermediate transfer belt 10 is hung to rotate by three supporting rollers 14, 15, 16, and is able to rotationally transport. In FIG. 1, among the three supporting rollers 14, 15, 16, a cleaning device 17 for removing toner residual on the intermediate transfer belt 10 after an image has been transferred is installed at the left of the second supporting roller 15. A tandem-type image forming device 20 is formed by disposing four image forming devices 18 (respectively for black, yellow, magenta and cyan) along the transporting direction of the intermediate transfer belt 10 across the intermediate transfer belt 10 stretched by the fist supporting roller 14 and the second supporting roller 15 (among the three supporting rollers 14, 15, 16).

As shown in FIG. 1, an exposure device 21 is further installed over the tandem-type image forming device 20. On the other hand, a secondary transfer device 22 is arranged at a position opposite to the tandem-type image forming device 20 wherein the intermediate transfer roller 10 is between the tandem-type image forming device 20 and the secondary transfer device 22. As shown, the secondary transfer device 22 is constituted by a secondary transfer belt 24 (endless belt) stretched between two rollers 23, and is arranged to press to contact with the third supporting roller 16 through the intermediate transfer belt 10, so that an image on the intermediate belt 10 is transferred onto a sheet.

A fixing device 25 for fixing a transferred image on the sheet is installed by the side of the secondary transfer device 22. The fixing device 25 is formed by structure where a pressure roller 27 is pressed to contact with an endless fixing belt 26. The secondary transfer device 22 possesses a sheet transport function for transporting the sheet on which the image has been transferred to the fixing device 25. The secondary transfer device 22 can also arrange a transfer roller or a non-contact charger. In this case, it is difficult to incorporate the sheet transport function.

Additionally, in FIG. 1, a sheet reversing device 28, which is used for reversing the sheet where the image should be recorded on its two sides, is disposed under the fixing device 25 and the secondary transfer device 22 and is parallel with the tandem-type image forming device 20.

When using the above color electrophotographic copying machine to copy, a document is set on a document stage 30 of the automatic document feeding device 400; otherwise, opening the automatic document feeder device 400, the document is set on a contact glass 21 of the scanner 300. Thereafter, the automatic document feeder device 400 is close to press the document.

As pressing a start button (not shown), when the document is set on the automatic document feeder device 400, the document is transported and moved to above the contact glass 32, or the scanner 300 is immediately driven as the document is set on the contact glass. Thereafter, a first running body 33 and a second running body 34 begin to run. Light is emitted from a light source at the first running body 33, and a reflection light from the document's surface is further reflected to the second running body 34, and then further reflected by mirrors of the second running body 34. The light reflected by the mirrors is transmitted to a reading sensor 36 through an image forming lens 36, so as to read the document's content.

By pressing a start button (not shown), the supporting rollers 14, 15, 16 are rotationally driven one by one by a driving motor (not shown), and the other two supporting rollers are driven to rotate. The intermediate transfer belt 10 is rotated to transport accordingly. At the same time, the photoreceptor 40 in each image forming device 18 is rotated, and single color images of black, yellow, magenta and cyan are respectively formed on each photoreceptor 40. Thereafter, the intermediate transfer belt 10 transports, and each single color image is transferred in turn, so that a composite color image is formed on the intermediate transfer belt 10.

On the other hand, by pressing a start button (not shown), one of the paper-feeding rollers 42 in the paper-feeding table 200 is selected to rotate, and therefore, a sheet is set out from one of the paper-feeding cassettes 44 having plural decks in a paper bank 43. The sheet is then separated one by one by a separating roller 45 to enter a paper-feeding passage 46, transported by a transporting roller 47, and then guided along a paper feeding passage 48 in the copy device main body 100. The sheet is then run into a resist roller 49 to stop. Otherwise, a paper-feeding roller 50 is rotated to send out a sheet on a manual tray 51, and the sheet is separated one by one by a separating roller 52 to enter a manual paper-feeding passage 46. The sheet is then run into the same resist roller 49 to stop.

Accommodating the timing of the composite color image on the intermediate transfer belt 10, the resist roller 49 is rotated, and therefore, the sheet is sent to between the intermediate transfer belt 10 and the secondary transfer device 22. In this way, the color image is transferred by the secondary transfer device 22 and is recorded on the sheet.

After the color image is transferred, the sheet is transported by the secondary transfer device 22 and then sent to the fixing device 25. After the transferred color image is fixed by applying heat and pressure by the fixing device, the sheet is switched by a switching claw 55 and then ejected by an ejecting roller 56 to stack on a paper-ejecting tray 57. On the other hand, the sheet is switched by the switching claw 55 to enter the sheet reversing device 28, at which the sheet is reversed and guided to the transferring position again. After the image is also recorded on the back side of the sheet, the sheet is ejected to the paper-ejecting tray 57 by the ejecting roller 56.

After the color image is transferred, residual toner on the intermediate transfer belt 10 is removed by the cleaning device 17. Therefore, the tandem-type image forming device 20 is ready for next image formation.

In general, to ground the resist roller 49 is widely used, but a bias can be also applied to the resist roller 49 in order to remove the paper powder on the sheet. For example, a conductive rubber roller is used to apply a bias. The conductive NBR rubber has a diameter of ϕ18 and a surface thickness of 1 mm. The electric resistance is the volume resistance of the rubber material and is about $10^9$ Ωcm. A voltage of about −800V is applied to the outer side (surface side) at which the toner is transferred, and a voltage of about +200V is applied to the inner side.

In general, because the paper powder is difficult to remove from the photoreceptor in the intermediate transfer manner, if the necessary when amount of the transfer of paper powder is not much, the resist roller needs not be grounded. In addition, as for the applying voltage, a DC bias is usually applied, but an AC voltage with a DC offset component can be also applied in order to charge the sheet more uniformly.

The paper surface after passing the resist roller 49 applied with a bias can be negatively charged slightly. In this way, for the transfer from the intermediate transfer belt to the sheet, the transfer condition is changed in comparison with that no voltage is applied to the resist roller 49. Therefore, sometime, it might to change the transfer condition.

Figure 2:
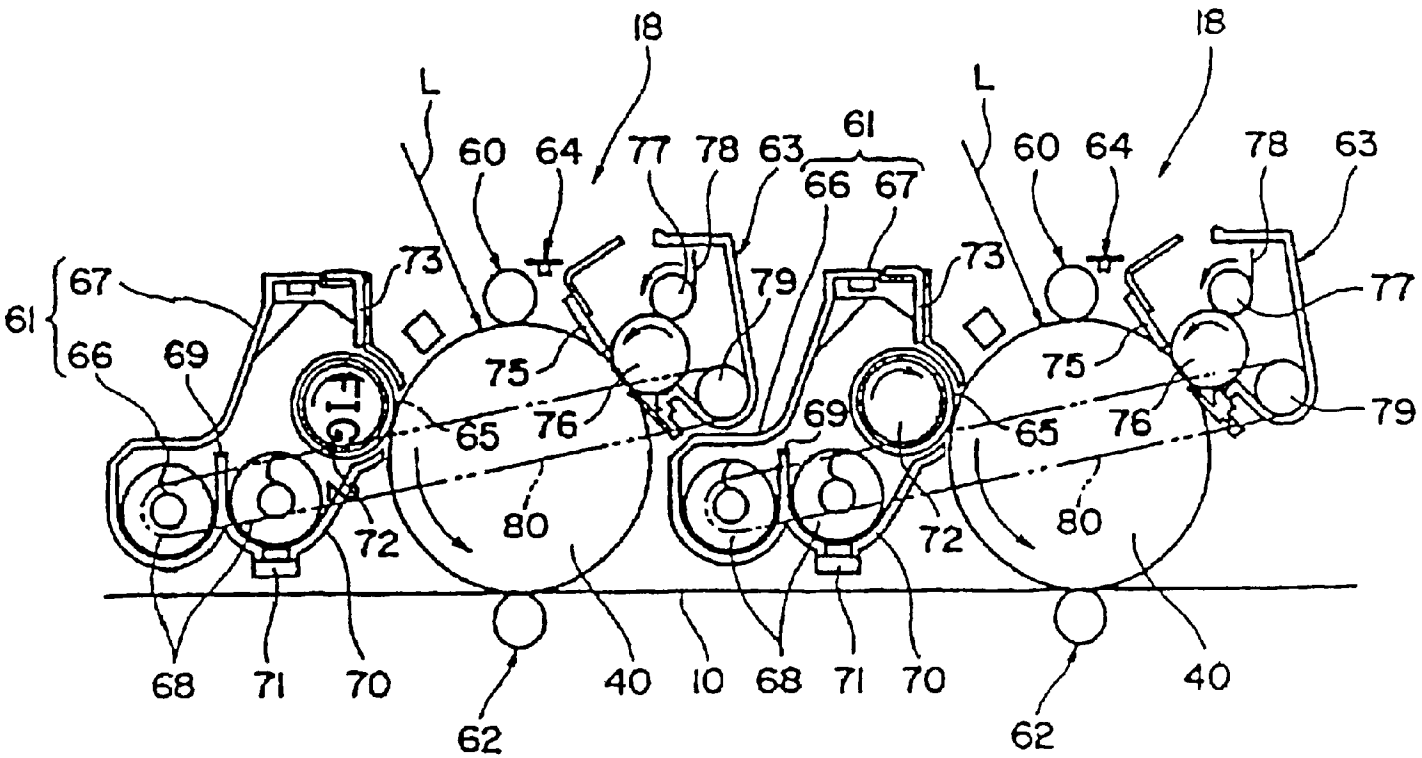
FIG. 2 is an enlarged diagram showing the peripherals of the photoreceptor in FIG. 1

As shown in FIG. 2, in tandem-type image forming device 20 as described above, each image forming device 18, for example, comprises a charging device 60, a developing device 61, a first transfer device 62, a photoreceptor cleaning device 63, and a discharging device 64, etc. formed around the drum-shaped photoreceptor 40.

Referring to FIG. 2, the charging device 60 of the image forming device 18 is constituted of a charging roller. The charging device 60 is in contact with the photoreceptor 40 to apply a voltage thereon so as to charge the photoreceptor 40. The charging device 60 can use a non-contact type scorotron charger to charge the photoreceptor 40.

The developing device 61 can use a one-component developer. However, in this embodiment, a two-component developer composed of magnetic carriers and non magnetic toner is used. Referring to FIG. 2, the developing device 61 comprises a stirring unit 66 for stirring and transporting the two-component developer, and then providing the two-component developer to adhere onto a developing sleeve 65; and a developing unit 67 for transferring the toner in the two-component developer adhered on the developing sleeve 65 onto the photoreceptor 40. The stirring unit 66 is lower in position in comparison with the developing unit 67.

Two parallel screws 68 are disposed in the stirring unit 66. Except for the end portions, the two screws 68 are separated by a partition plate 69. In addition, a toner concentration sensor 71 is installed in the developing case 70.

In the developing unit 67, the developing sleeve 65 is installed in such a way that is opposite to the photoreceptor 40 through an opening of the developing case 70, and a magnet 72 is fixed to install within the developing sleeve 65. Furthermore, a doctor blade 73 is disposed in the vicinity of the front end of the developing sleeve 65.

The two-component developer is provided to the developing sleeve 65, while stirring the two-component developer by using the two screws 68 to transport and cycle. The developer provided to the developing sleeve 65 is drawn and kept by the magnet 72, and a magnetic brush is formed on the developing sleeve 65. As the developing sleeve 65 rotates and by the doctor blade 73, the magnetic brush is properly cut. The cut off developer returns to the stirring unit 66.

The toner in the developer on the developing sleeve 65 is transferred to the photoreceptor 40 by a developing bias voltage that is applied to the developing sleeve 65, and then the electrostatic latent image on the photoreceptor 40 is visualized. After visualization, the developer remained on the developing sleeve 65 is separated from the developing sleeve 65 at a position where the magnetic force of the magnet 72 does not reach, and then returns to the stirring unit. By repeating these processes, as the toner concentration in the stirring unit 66 becomes thin, the toner concentration sensor 71 detects that and toner is further supplied to the stirring unit 66.

The first transfer device 62 is a roller shape, and is installed to press to contact with the photoreceptor 40 through the intermediate transfer belt 20. Moreover, the first transfer device 62 does not limit to a roller shape, a conductive brush shape or a non-contact type corona charger, etc. can be also used. The photoreceptor cleaning device 63's tip is pressed to contact with the photoreceptor 40, and has a cleaning blade 75 made of, for example, polyurethane rubber. In order to increase the cleaning property, a brush whose outer rim contacts with the photoreceptor 40 is further incorporated. For example, as shown in FIG. 2, a contact conductive fur brush whose outer rim contacts with the photoreceptor 40 is arranged to be able to freely rotate in the arrow direction. In addition, a metal electric field roller 77 for applying a bias to the fur brush 76 is arranged to be able to freely rotate in the arrow direction. The tip of the scraper 78 is pressed to contact with the electric field roller 77. A recycling screw 79 is further installed for recycling the removed toner.

The residual toner on the photoreceptor 40 is removed by using the fur brush 76 that rotates in a counter direction with respect to the photoreceptor 40. The toner adhered on the fur brush 76 is removed by a bias-applied electric field roller 77 that rotates and is in contact with the position opposite to the fur brush 79. The toner adhered on the electric field roller 77 is cleaned by the scraper 78. The toner recycled by the photoreceptor cleaning device 63 is gathered at one side of the photoreceptor cleaning device 63 by the recycling screw 79, and returns to the developing device 61 by using a toner recycling device 80 for reuse.

The discharging device 64 can, for example, a lamp. The lamp irradiates light to initiate the photoreceptor 40's surface potential.

As the rotation of the photoreceptor 40, the photoreceptor 40's surface is similarly charged by the charging device 60, and then a writing beam L of a laser or LED from the aforementioned exposure device 21 corresponding to the content read by the scanner 300 is irradiated, so as to form the electrostatic latent image on the photoreceptor 40. Afterwards, the toner is adhered by the developing device 61 to visualize the electrostatic latent image. This visualized image is transferred to the intermediate transfer belt 10 by the first transfer device 62. After the image is transferred, the photoreceptor 40's surface is cleaned by the photoreceptor cleaning device 63 to remove the residual toner thereon, and then is discharged by the discharging device 64 for the next image formation.

Referring to FIG. 1 again, among the three supporting rollers 14, 15, 16 that stretch the intermediate transfer belt 10, the supporting roller 16 disposed at the downstream side of the secondary transfer device 22 functions as a separating roller for separating a transfer paper (as a transfer material where the composite toner image is transferred thereon at the secondary transfer device 22) or an OHP sheet from the intermediate transfer belt 10. Namely, the transfer material (the transfer paper) where the transfer is finished is separated from the intermediate transfer belt 10 due to the curvature of a transfer material separating section that is constituted by winding the intermediate transfer belt 10 on the supporting roller 16.

If the intermediate transfer belt 10's winding angle with respect to the supporting roller (the separating roller) 16 that forms the transfer material separating section is small, the transfer material's separation property at the transfer material separating section gets worse. In the worst situation, the transfer material is not separated at the transfer material separating section, and is wound on the intermediate transfer belt 10 to transport.

Figure 3:
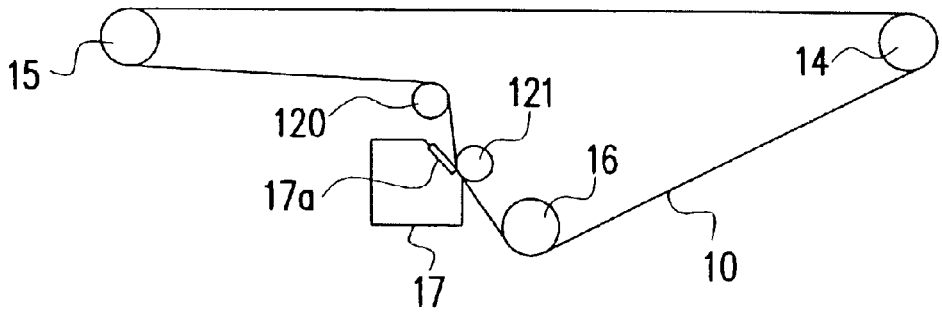
FIG. 3 is a schematic structure of the intermediate transfer belt in FIG. 1.

Referring to FIG. 3, in order to improve the transfer material's separation property at the transfer material separating section of the tandem-type image forming device 20, the inventor proposes that a bending member 120 is installed between the first transfer device 62 and the secondary transfer device 22, so that the toner image's supporting surface of the intermediate transfer belt 10 between the first transfer device 62 and the secondary transfer device 22 is bent towards the inner surface by the bending member 120.

By using the aforementioned structure, the curvature of the intermediate transfer belt 10 at the transfer material separating section can be equal to the curvature of the supporting roller (the separating roller) 16. The bending member 120 is in general a roller, but is not limited to the roller structure.

The perimeter of the intermediate transfer belt 10 varies with the initial tolerance, the environment and time. In the example of the tandem-type image forming device 20 according to this embodiment, the initial perimeter of the intermediate transfer belt 10 is 950 mm at the room temperature, but it is necessary to consider the tolerance of about ±2 mm, the contraction and expansion amount of about ±2 mm due to the use environment (temperature), and the belt's the expansion amount of about 2~3 mm after a long time use. As a result, a prediction of a maximum perimeter deviation of about 10 mm is necessary.

Therefore, in the tandem-type image forming device using the intermediate transferring manner, it is necessary to absorb the variation of the intermediate transfer belt 10's perimeter and to stabilize the runnability of the intermediate transfer belt 10. In the tandem-type image forming device of the embodiment, the bending member 120 is constituted by a roller, and a spring is used to displaceably support the bending member 120, so that the intermediate transfer belt 10's toner image supporting surface is elastically pressed by the bending member 120.

As shown in FIG. 3, when the entire toner image supporting surface of the intermediate transfer belt 10 is pressed by the bending member 120, a belt cleaning device 17 for removing the residual toner remained on the intermediate transfer belt 10 after the secondary transfer stage is disposed between the bending member 120 and the supporting roller 16 (also used as the separating roller) to clean up the toner image supporting surface of the intermediate transfer belt 10.

As described above, when the perimeter of the intermediate transfer belt 10 has variation, the position of the bending member 120 that presses the intermediate transfer belt 10 becomes a barrack. For example, in a case that the initial perimeter of the intermediate transfer belt 10 is 950 mm (at 23° C.), if the perimeter of the intermediate transfer belt 10 has a variation of 10 mm, the bending member 120 moves by 7 mm.

Therefore, when no other element is disposed at a position opposite to the cleaning blade 17*a* that is used as a cleaning element of the belt cleaning device 17, the belt pressing position of the bending member 120 is changed due to the change of the intermediate transfer belt 10's perimeter, so that a position deviation between the intermediate transfer belt 10 and the cleaning blade 17*a* of the belt cleaning device 17 is created. To clean the residual toner by the cleaning blade 17*a* gets worse.

Namely, when the belt perimeter of the intermediate transfer belt 10 becomes longer, the position of the bending element 120 is changed towards a direction where the intermediate transfer belt 10 and the cleaning blade 17*a* are separated. As the position of the bending element 120 is changed towards a direction where the intermediate transfer belt 10 and the cleaning blade 17*a* are separated, the contact angle and the engaging amount between the cleaning blade 17*a* and the intermediate transfer belt 10 are deceased, and therefore, the ability to clean the residual toner by the cleaning blade 17 is reduced.

Figure 4:
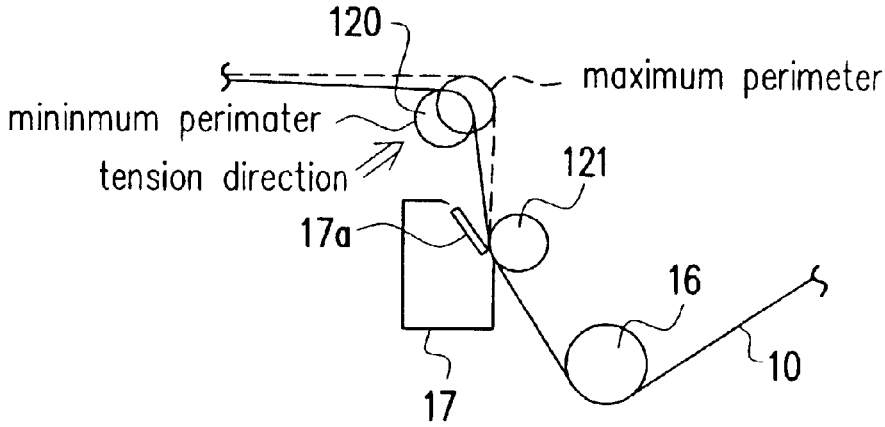
FIG. 4 is a schematic structure of a toner recycling device.

In the tandem-type image forming device of this embodiment, as shown in FIG. 4, an opposite member 121 is dispose at a position opposite to the cleaning device 17 to sandwich the intermediate transfer belt 10. In this way, even though the position of the bending member 120 is changed to a dash-line position as shown in FIG. 4 due to the variation of the intermediate transfer belt 10's perimeter, cleaning position for the residual toner on the intermediate transfer belt 10 does not changed.

In the foregoing embodiment, a roller is used as the bending member 120, but this is not used to limit the scope of the invention. However, when the bending member 120 uses a roller to contact with the outer surface of the intermediate transfer belt 10 and rotate, the degradation of the outer surface of the intermediate transfer belt 10 can be suppressed to minimum, so as to stabilize the belt running of the intermediate transfer belt 10.

As described above, in the tandem-type image forming device of this embodiment, by using the opposite member 121, the toner image supporting surface of the intermediate transfer belt 10 is regularly contact with the cleaning blade 17*a* of the cleaning device 17 that is disposed between the bending member 120 and the secondary transfer device 22. In this way, even though the position of the bending member 120 is changed due to the expansion and the contraction of the intermediate transfer belt 10, the contact angle and the engaging amount between the cleaning blade 17*a* and the intermediate transfer belt 10 can be stabilized, and a good cleaning ability can be maintained.

As shown in FIG. 3, it is preferred that the opposite member 121 is disposed in such a manner that the intermediate transfer belt 10's inner surface is bent towards the outer surface side of the intermediate transfer belt 10. In this manner, the contact angle and the engaging amount between the cleaning blade 17*a* and the intermediate transfer belt 10 can be more stabilized.

In addition, as described above, it is preferred that the bending member 120 is a tension member that provides a tension to the intermediate transfer belt 10 by the displacement of the bending member 120 itself. In this way, because the tension is provided to the intermediate transfer belt 10 by the bending member 120, the belt running ability of the intermediate transfer belt 10 at a portion that is in contact with the cleaning blade 17*a* can stabilized and a good cleaning ability can be maintained.

It is preferred that the intermediate transfer belt 10 has a perimeter that a contact portion to the opposite member 121 is bent to the outer surface side of the intermediate transfer belt 10, even though the intermediate transfer belt 10 has a smallest perimeter and the bending member (the tension member) 120 has a maximum displacement to the outer surface side of the intermediate transfer belt 10. In this way, the perimeter of the intermediate transfer belt 10 becomes minimum because of its initial tolerance, application environment and variation with time. As the solid line shown in FIG. 4, even though the bending member (the tension member) 120 has a maximum displacement to the outer surface side of the intermediate transfer belt 10, the intermediate transfer belt 10's contact portion with the opposite member 121 is bent to the outer surface side of the intermediate transfer belt 10. Therefore, even though the intermediate transfer belt 10's perimeter is changed because of its expansion and contraction, the contact angle and the engaging amount between the cleaning blade 17*a* and the intermediate transfer belt 10 can be regularly stable, and a good cleaning ability can be maintained.

In addition, it is preferred that the opposite member 121 is a roller that is able to rotate and in contact with inner surface of the intermediate transfer belt 10. In this manner, by using the roller as the opposite member 121, the degradation of the inner surface of the intermediate transfer belt 10 can be suppressed to minimum and the running ability of the intermediate transfer belt 10 can be also stabilized.

Figure 5:
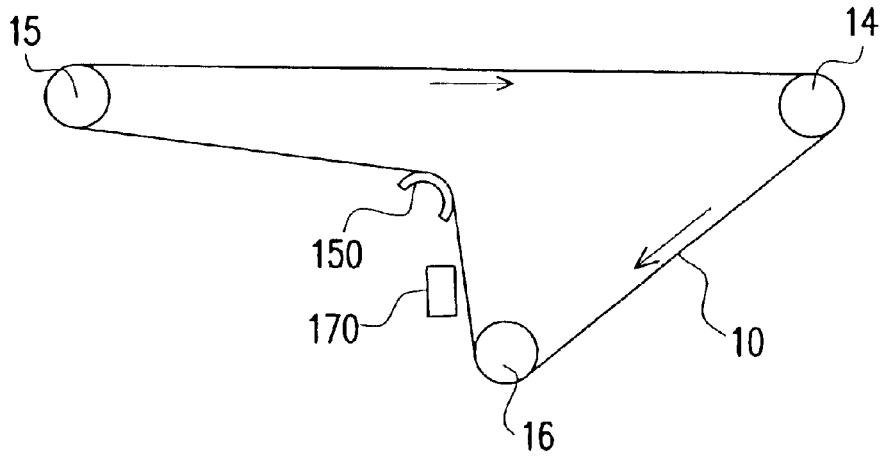
FIG. 5 is a schematic diagram showing a common structure of the embodiments.

Before proceeding the following embodiment, a belt device suitable for these embodiment, as shown in FIG. 5, is first described in general. The elements having the same or similar functions as the first embodiment are labeled with the same numbers. Referring to FIG. 5, the belt device comprises an endless belt 10, a driving roller 14, supporting rollers 15, 16, and a bending member 150. The belt 10 is rotationally driven by the driving roller 14 in a predetermined direction (the arrow direction). The supporting roller 2 is disposed at a position of the loose side of the belt 10 that is driven to rotate by the driving roller 14, and is used for supporting the belt 10. A bending member 150 is disposed at the downstream side of the supporting roller 15 in the belt 10's rotational direction, so that the belt 10's outer surface is bent to the inner surface side.

In addition, the belt device further comprises an acting member 170 that is disposed between the supporting roller 16 and the bending member 150. This acting member 170 is used for providing a predetermined action against the belt 10's outer surface by maintaining a predetermined position relationship of the belt 10's outer surface. This acting member 170 can be, for example, the cleaning device 17 (see FIG. 20), or a coating member for coating a lubricant (such as zinc stearate, etc.) on the belt 10's outer surface. In addition, this acting member can be also a charging unit for charging the belt 10's outer surface, a discharging unit for removing charges on the belt 10's outer surface, or an exposure unit for exposing the belt 10's outer surface. Moreover, it should be noted that the belt 10 of the belt device can be the intermediate transfer belt, the photoreceptor belt, the paper transporting belt, or the fixing belt, etc.

In such a belt device as described above, as the bending member 150 is displaced or loosened because of its expansion and contraction, there is a position deviation created between the acting member 170 and the belt 10's outer surface. As the position deviation between the acting member 170 and the belt 10's outer surface is created, the acting member 170 cannot achieve the predetermined action against the belt 10's outer surface. This problem can be solved by using the embodiments as described below. In the following embodiments, each element in the belt device having the same or similar function as that in FIG. 5 is labeled with the same number.

<<Second Embodiment>>

Figure 6:
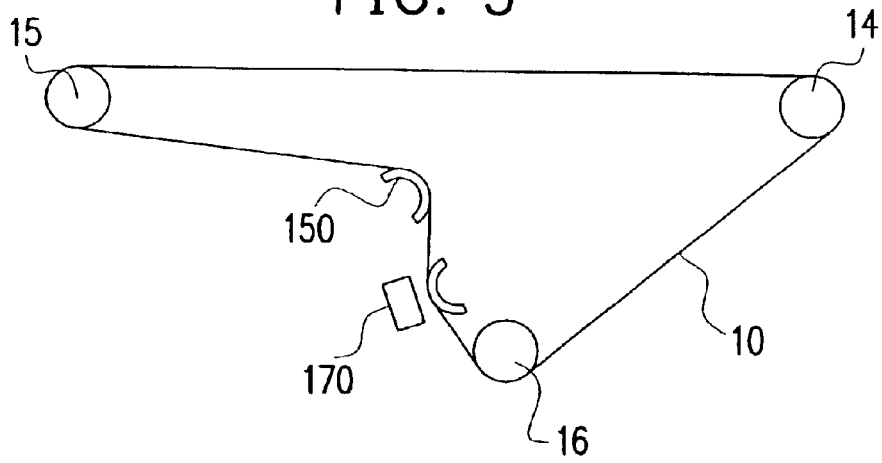
FIG. 6 is a schematic diagram showing a structure of the second embodiment.

In addition to the elements constituting the belt device shown in FIG. 5, the belt device of the second embodiment has following features. Referring to FIG. 6, according to the belt device of the second embodiment, an opposite member 160 that is in contact with the belt 10's inner surface is disposed at a position opposite to the acting member 170, so as to sandwich the belt 40. In FIG. 2, the opposite member 160 is formed by bending resin or light alloy, etc, and the opposite member 160's bending surface is in contact with the belt 10's inner surface.

<<Third Embodiment>>

Figure 7:
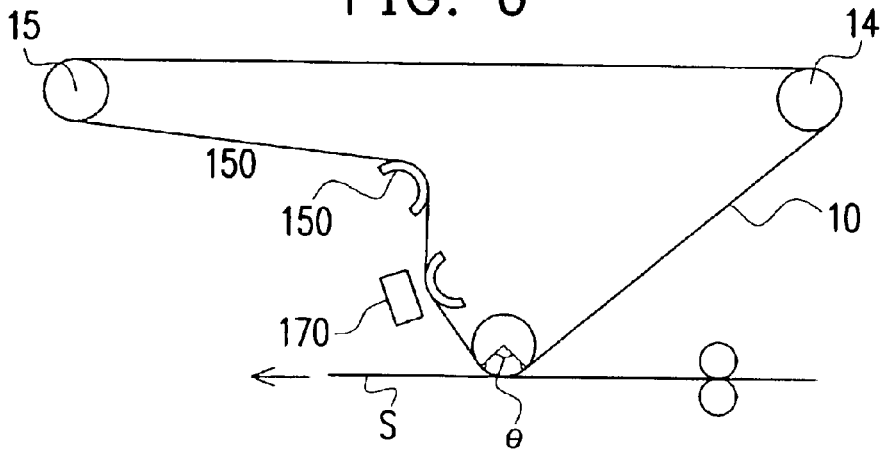
FIG. 7 is a schematic diagram showing a structure of the third embodiment.

In addition to the elements constituting the belt device of the second embodiment shown in FIG. 6, the belt device of the third embodiment as shown in FIG. 7 further comprises following features. Referring to FIG. 7, according to the belt device of the third embodiment, the opposite member 160 is in contact with the belt 10's inner surface, such that the belt 10's winding angle θ with respect to the supporting roller 16 is set to an angle that the sheet S can be separated from the belt 10's outer surface. Namely, the supporting roller 16 functions as a separating means to separate the sheet S, which is transported along the belt 10's outer surface, from the belt 10's outer surface. Referring to FIG. 7, the sheet S is transported along the belt 10's outer surface of the supporting roller 16's upstream side in a direction same as the belt 10's rotational direction. In the above belt device, for example, as the belt 10 is charged, the sheet S transported along the belt 10's outer surface is electrostatically sealed and wound on the belt 10's outer surface. The belt device of the third embodiment utilizes the belt 10's winding angle θ with respect to the supporting roller 16 to separate the sheet S from the belt 10's outer surface. The belt 10's winding angle θ with respect to the supporting roller 16 is obtained and calculated according to experiment in advance, so that the sheet S transported along the belt 10's outer surface can be smoothly separated from the belt 10's outer surface.

<<Fourth Embodiment>>

Figure 8:
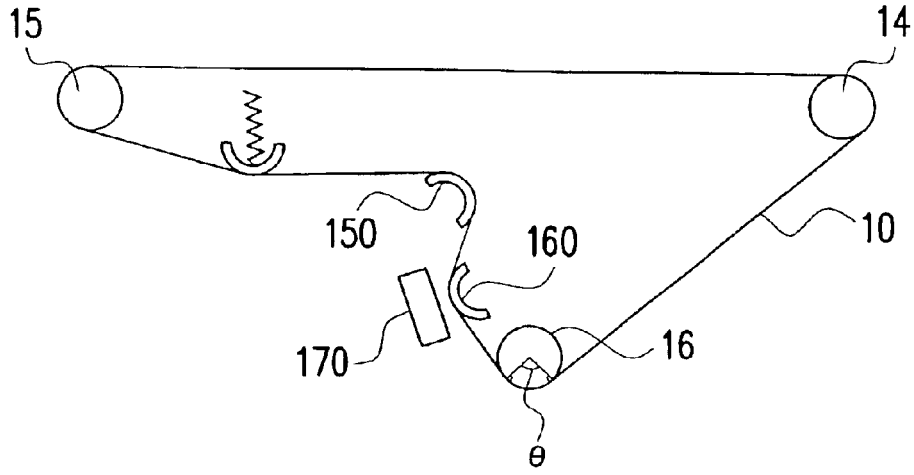
FIG. 8 is a schematic diagram showing a structure of the fourth embodiment.
Figure 9:
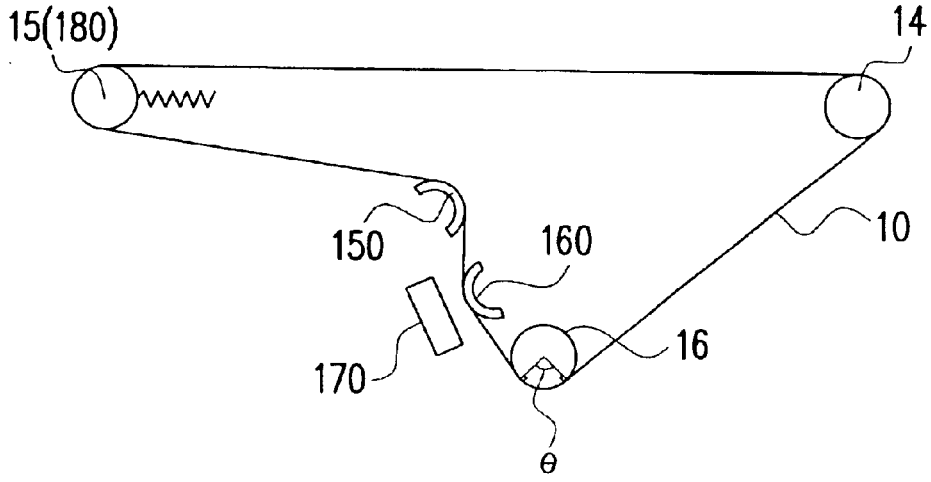
FIG. 9 is a schematic diagram showing another structure of the fourth embodiment.

In addition to the elements constituting the belt device of the second or the third embodiment shown in FIGS. 6 and 7, the belt device of the fourth embodiment as shown in FIG. 8 further comprises following features. Referring to FIG. 8, the belt device of the fourth embodiment comprises a belt tension applying member 180 for providing a predetermined tension against the belt 10. The belt tension applying member 180 is disposed at a position, so that he belt 10's winding angle θ with respect to the supporting roller 16 does not change because of the belt tension applying member 180's displacement. In the belt device shown in FIG. 8, the belt tension applying member 180 is disposed at the downstream side of the bending member 150 in the belt 10's rotational direction. In addition, as shown in FIG. 9, the belt tension applying member 180 can be formed at the downstream side of the bending member 150 in the belt 10's rotational direction and function as a supporting member 15 to support the belt 10. Because the belt device shown in FIG. 9 has a structure that the belt tension applying member 180 also functions as the supporting member 15, the belt device is simpler and cheaper.

<<Fifth Embodiment>>

Figure 10:
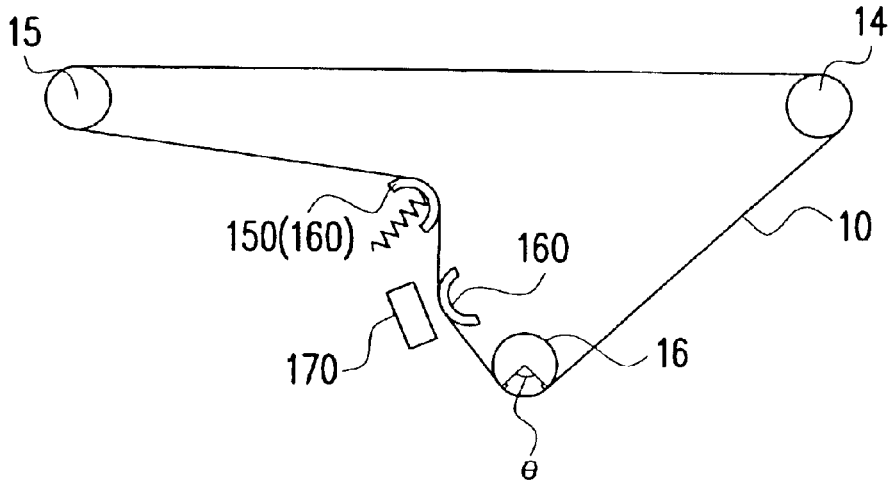
FIG. 10 is a schematic diagram showing a structure of the fifth embodiment.

In addition to the elements constituting the belt device of the second, the third, or the fourth embodiment shown in FIGS. 6, 7, 8 and 9, the belt device of the fifth embodiment as shown in FIG. 10 further comprises following features. Referring to FIG. 10, in the belt device of the fourth embodiment, the bending member 150 has a structure that functions as the belt tension applying member 180. Namely, in the belt device, the bending member 150 is elastically in contact with the belt 10's outer surface by a coil spring, i.e., the belt tension applying member 180.

<<Sixth Embodiment>>

Figure 11:
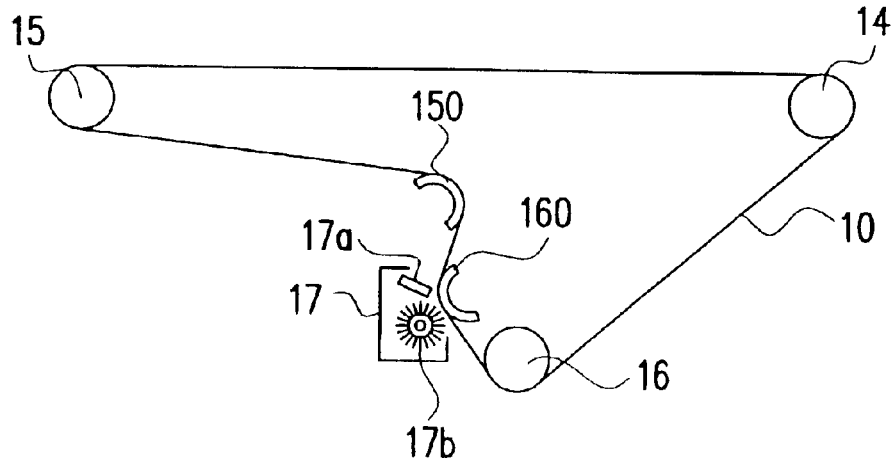
FIG. 11 is a schematic diagram showing a structure of the sixth embodiment.

In addition to the elements constituting the belt device of the second, the third, the fourth or the fifth embodiment shown in FIGS. 6–10, the belt device of the sixth embodiment as shown in FIG. 11 further comprises following features. Referring to FIG. 11, the acting member 170 can be a cleaning device 20, which comprises a cleaning blade 17*a* and a cleaning brush 17*b*. The cleaning device 20 is used to remove the contaminant adhered on the belt 10's outer surface so as to clean the belt 10's outer surface. When the belt 10 is a toner supporter, such as the photoreceptor belt or the transferring belt, the residual toner on the belt's outer surface is removed by the cleaning device 20. In addition, when the belt 10 is a paper transporting means, such as the paper transporting belt or the fixing belt, the paper powder, etc. on the belt is removed by the cleaning device 20.

<<Seventh Embodiment>>

Figure 12:
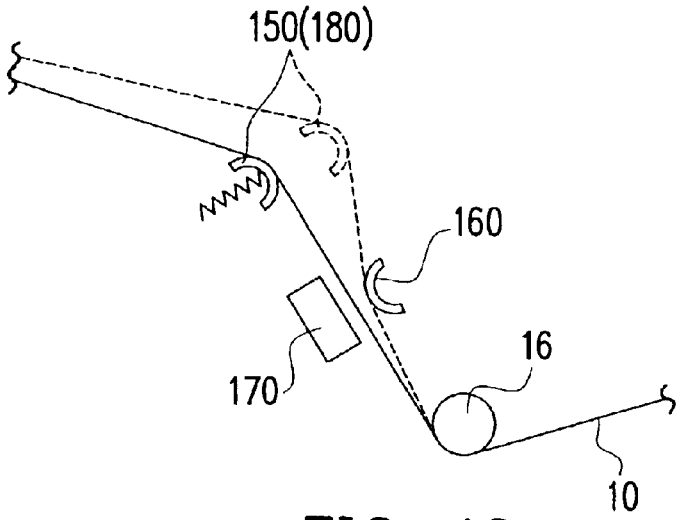
FIG. 12 is a schematic diagram showing the behavior of the belt of each second embodiment.
Figure 13:
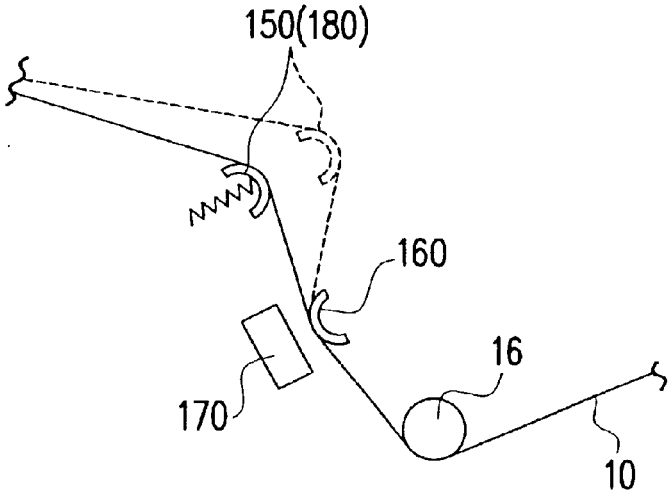
FIG. 13 is a schematic diagram showing a structure of the seventh embodiment.

In addition to the elements constituting the belt device of the fifth embodiment shown in FIG. 10, the belt device of the seventh embodiment further comprises following features. The seventh embodiment further restrict the installation position of the bending member 150. Referring to FIG. 12, in the belt device where the bending member 150 also functions as the belt tension applying member 180 (referring to FIG. 10), as the belt 10's perimeter is changed due to the belt 10's expansion and contraction, the bending member 150 is displaced. When the belt 10 has a maximum contraction, the belt 10's perimeter becomes minimum. When the belt 10 has a maximum expansion, the bending member 150 absorbs the loose amount of the belt 10 due to the variation of the belt 10's perimeter, and the bending member 150 displaces according to the variation of the belt 10's perimeter. When the belt is stretched to become a maximum belt perimeter, even though the bending member 150 displaces to a position shown in the dash line in FIG. 12, the position deviation between the opposite member 160 and the belt 10's outer surface does not occur. However, when the belt is contracted to become a minimum belt perimeter, the bending member 150 is displaced to the solid line position, and a deviation is created in the position relationship between the opposite member 160 and the belt 10's inner surface. As described above, the deviation in the position relationship between the opposite member 160 and the belt 10's inner surface affects adversely on the acting member 170. In the belt device as shown in FIG. 13, even though the belt 10 has a maximum contraction and the bending member 150 displaces to the outer surface side of the belt 10, the position of the opposite member 160 is prescribed, so that the opposite member 160 is pressed to be in contact with the belt 10's inner surface. In this manner, the position relationship between the opposite member 160 and the belt 10's inner surface is not affected by the expansion and contraction of the belt 10, and can be constantly maintained.

<<Eighth Embodiment>>

Figure 14:
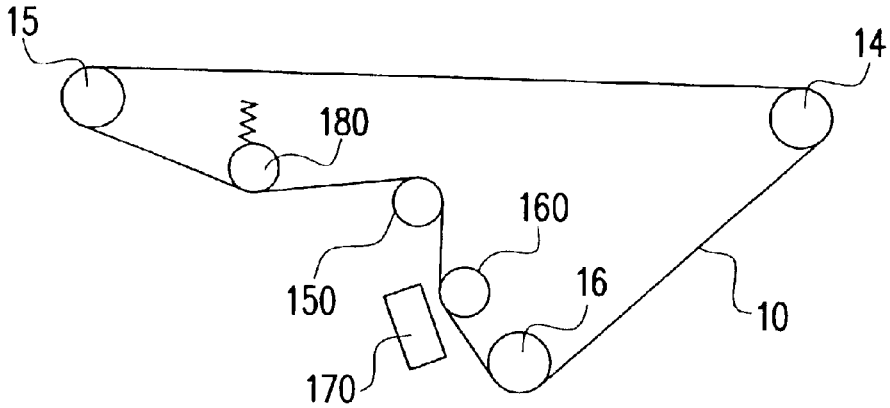
FIG. 14 is a schematic diagram showing a structure of the eighth embodiment.

In addition to the elements constituting the belt device of the second, the third, the fourth, the fifth, the sixth or the seventh embodiment shown in FIGS. 6–13, the belt device of the eighth embodiment as shown in FIG. 14 further comprises following features. Referring to FIG. 14, the opposite member 160 and the belt tension applying member 180 are respectively formed by roller. Among the bending member 150, the opposite member 160, and the belt tension applying member 180, any one or two of them can be formed by roller. In this manner, to form the above members 150, 160, 180 can reduce the contact friction between the belt 10's inner surface and each of the members 150, 160, 180 when the belt is rotated.

The second to the eighth embodiments is also applicable to the color electrophotographic copying machine shown in FIG. 1. For simplicity, the detail structure and operation are omitted.

Referring to FIG. 1, in the image forming device, the belt outer surface of the intermediate transfer belt 10 is bent by the bending member 150 to the belt 10's inner surface side. Therefore, in the image forming device, a sufficient winding angle θ of the with respect to the intermediate transfer belt 10 the supporting roller 16 can be obtained. In this way, in the image forming device, the transfer paper S at the intermediate transfer belt 10's separating section can be smoothly separated, and therefore, the separating charger or the separating claw for separating the transfer paper S is not required. In addition, by bending the intermediate transfer belt 10 to the belt 10's inner surface side by using the bending member 150, the freedom degree of the intermediate transfer belt 10's creep is increased, and therefore, to save the belt device's space can be achieved.

The rollers 14, 16, 15, 150 are pivotally supported by a frame pair (not) to rotate freely. In addition, the frame pair is oppositely arranged, so that a space at least larger than the width of the intermediate transfer belt 10 is formed. Referring to FIG. 1, the frame pair is detachable from a predetermined installation position in the device main body 100. Furthermore, as the frame pair is installed at the predetermined installation position in the device main body 100, the belt device has a driving force transmitting device for transmitting a driving force form a driving source installed in the device main body 100 to the driving roller 14. This driving force transmitting device can be a coupling, a Bebel gear, or an electromagnetic clutch, etc.

Figure 15:
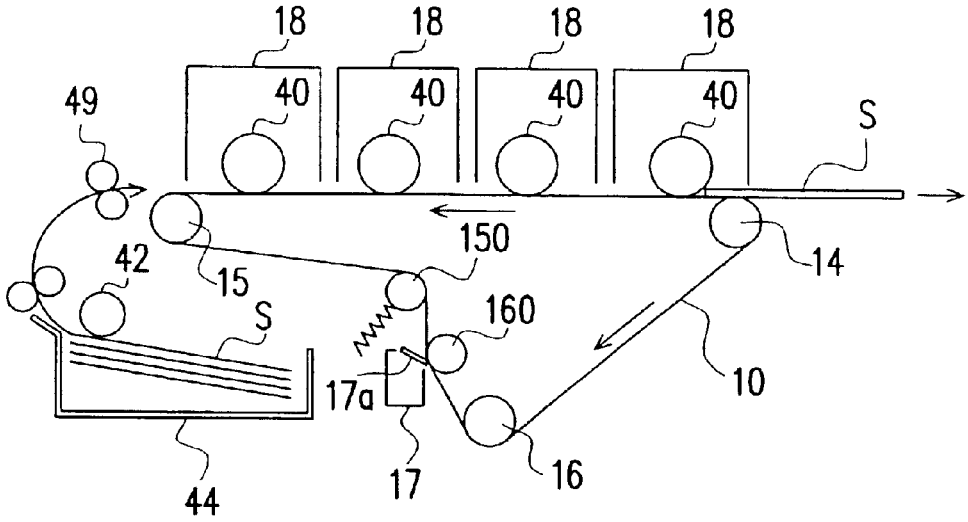
FIG. 15 shows a schematic structure of another image forming device.

FIG. 15 shows an example of an image forming device that the belt 10 of the belt device functions as a paper transporting belt. In addition, each element in this image forming device having the same or similar structure or function as that in FIG. 1 is labeled with the same number and its corresponding description is omitted.

Referring to FIG. 15, as the driving roller 14 rotates, the paper transporting belt 10 is driven to rotate in the arrow direction, by which the toner image on the photoreceptor 40 of each image forming unit 18 for each color is formed. Synchronizing with the toner image's forming operation of each color, the transfer paper S is sent out from the paper feeding cassette 44. The transfer paper S is separately transported one by one, and then is in a standby status colliding with the resist roller 49. The transfer paper S is transported along the outer surface of the paper transporting belt 10 according to the timing that each color's toner image is formed on the photoreceptor 40. Each color's toner image formed on the photoreceptor 40 is sequentially overlapped on the transfer paper S that is transported along the belt outer surface of the paper transporting belt 10. In this manner, the color image is recorded on the transfer paper S.

Figure 16:
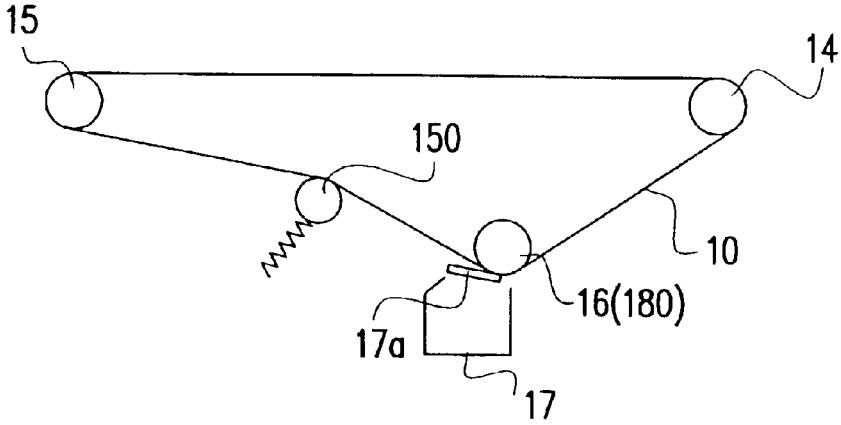
FIG. 16 shows another schematic structure of the image forming device in FIG. 15.
Figure 17:
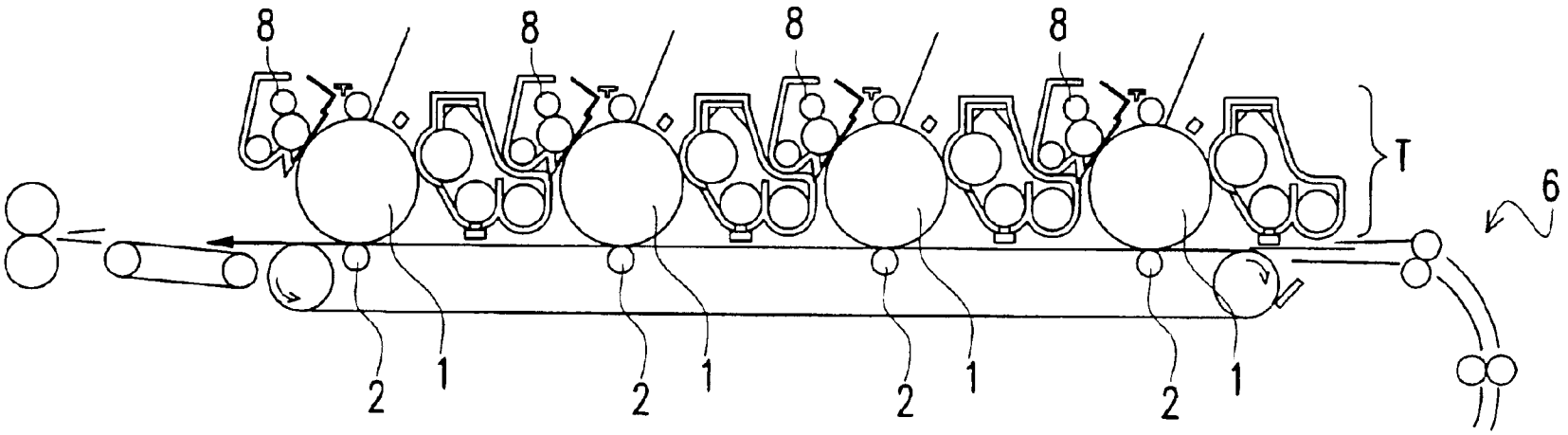
FIG. 17 (PRIOR ART)
FIG. 17 is a schematic structure of an image forming device of direct transfer type.
Figure 18:
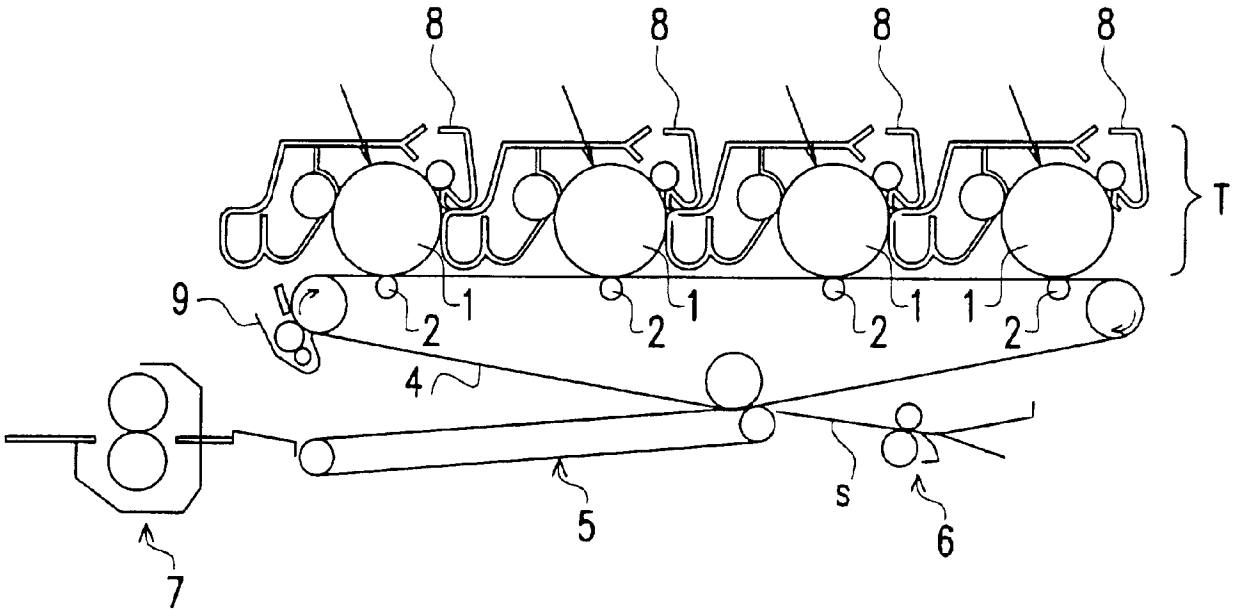
FIG. 18 (PRIOR ART)
FIG. 18 is a schematic structure of an image forming device of indirect transfer type.
Figure 19:
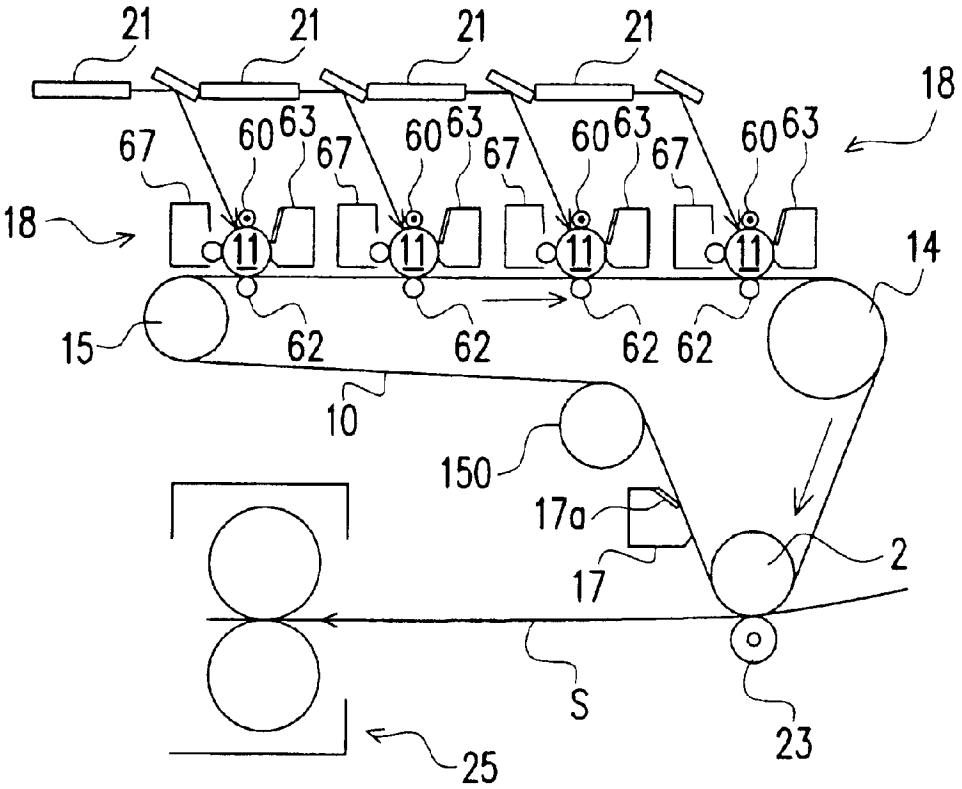
FIG. 19 (PRIOR ART)
FIG. 19 is a structure showing a conventional image forming device.

As shown in FIG. 15, by using the above belt device, even for the image forming device of the direct transfer type, the paper feeding cassette 44 can be disposed under the belt device, and therefore, a more compact image forming device can be formed. Additionally, in the image forming device of the direct transfer type, since the toner image is not transferred on the belt 10, it is not necessary to dispose a secondary transfer device on the outer surface of the belt 10. Therefore, in this image forming device as shown in FIG. 16, the belt cleaning device 17 can be disposed at a position opposite to the supporting roller 16. In this manner, the supporting roller 16 can have the function as the belt tension applying member 180, and therefore, a simple and low cost device can be achieved.

In the belt device of the above embodiments, since the opposite member 160 is in contact with the belt 10's inner surface, the belt's outer surface and the acting member 170 can maintain a predetermined position relationship. In this way, even though the bending member 150 is displaced by the belt 10's expansion and contraction or the belt is loose at the beginning of driving the belt 10, the deviation in the position relationship between the acting member 170 and the belt 10's outer surface does not occur.

In particular, in the belt device of the third embodiment, the opposite member 160 is in contact with the belt 10's inner surface and the belt 10's winding angle θ with respect to the supporting roller 16 is an angle that the sheet S can be separated from the belt 10's outer surface. Therefore, because of the belt 10's winding angle θ with respect to the supporting roller 16, the sheet S that is transported along the belt 10's outer surface can be smoothly separated from the belt 10's outer surface.

Alternatively, in the belt device of the fourth embodiment, even though the belt tension applying member 180 is displaced, the belt 10's winding angle θ with respect to the supporting roller 16 is not changed. Furthermore, in the belt device of the fifth embodiment, since the belt tension applying member 180 also functions as the bending member 160, the tension is provided against the belt 10. In this way, it is not necessary to dispose the belt tension applying member 180 independently, so that a low cost belt device can be achieved.

In the belt device of the sixth embodiment, by using the opposite member 160, the cleaning blade 17*a* or the fur brush 17*b* of the cleaning device 17 (as the acting member 170) and the belt 10's outer surface can maintain the predetermined position relationship. In this way, the belt 10's outer surface can be stable and cleaned up.

In the belt device of the seventh embodiment, the opposite member 160 and the belt 10's inner surface are not affected by the expansion or contraction of the belt 10, and the position relationship can be regularly maintained. In this way, even though the belt 10 is contracted and the belt 10's perimeter becomes minimum, the deviation in the position relationship between the opposite member 160 and the belt 10's inner surface does not occur.

In the belt device of the eighth embodiment, any one, two or all of the bending member 150, the opposite member 160 and the belt tension applying member 180 rotate and contact with the inner surface of the belt 10. In this way, when the belt 10 is rotated, the contact friction between the belt inner surface and each of the members 150, 160, 180 can be reduced, so that the belt is stably rotated. In addition, the wear due to the friction of the belt 10's inner surface is reduced, so that the belt's life can be extended In summary, according to one aspect of the invention, since a cleaning device for cleaning the intermediate transfer belt is disposed between the bending member and the separating roller and an opposite member is disposed at a position opposite to the cleaning device, the invention achieve excellent effects that the position relationship between the cleaning device and the intermediate transfer belt can be stabilized and a good cleaning ability of the cleaning device can be maintained.

In addition, according to another aspect of the invention, a predetermined position relationship between the outer surface of the belt and the acting member can be maintained. Therefore, there is an excellent effect that the action of the acting member against the belt becomes more stable.

While the present invention has been described with a preferred embodiment, this description is not intended to limit our invention. Various modifications of the embodiment will be apparent to those skilled in the art. It is therefore contemplated that the appended claims will cover any such modifications or embodiments as fall within the true scope of the invention.

What is claimed is:

1. An image forming device, comprising:

an endless intermediate transfer belt, stretched by a plurality of rollers;

a plurality of image supporters, disposed at positions opposite to the endless intermediate transfer belt;

a plurality of image forming units, for forming toner images respectively on each of the image supporters;

a first transfer device, for performing a first transfer stage, wherein each toner image formed on each image supporter is sequentially composed on the endless intermediate transfer belt at a first transfer section where the endless intermediate transfer belt and the image supporters are oppositely arranged;

a secondary transfer device, for performing a secondary transfer stage, wherein a composite toner image on the endless intermediate transfer belt is transferred at a secondary transfer section where the endless intermediate transfer belt and a transfer material are oppositely arranged;

a bending member, for bending a toner image supporting surface of the endless intermediate transfer belt between the first transfer section and the secondary transfer section towards an inner surface side of the endless intermediate transfer belt;

a cleaning device, disposed between the bending member and the secondary transfer section, for cleaning up the toner image supporting surface of the endless intermediate transfer belt;

an opposite member, disposed at a position opposite to the cleaning device to sandwich the endless intermediate transfer belt, and in contact with the inner surface of the endless intermediate transfer belt; and wherein the opposite member is disposed in a manner that the inner surface of the endless intermediate transfer belt is bent to the outer surface side of the endless intermediate transfer belt.

2. The image forming device of claim 1, wherein the bending member is a tension member for providing a tension against the endless intermediate transfer belt by a displacement of the bending member.

3. The image forming device of claim 1, wherein the opposite member is a roller that is rotated and is in contact with the inner surface of the endless intermediate transfer belt.

4. An image forming device, comprising:

an endless intermediate transfer belt, stretched by a plurality of rollers;

a plurality of image supporters, disposed at positions opposite to the endless intermediate transfer belt;

a plurality of image forming units, for forming toner images respectively on each of the image supporters;

a first transfer device, for performing a first transfer stage, wherein each toner image formed on each image supporter is sequentially composed on the endless intermediate transfer belt at a first transfer section where the endless intermediate transfer belt and the image supporters are oppositely arranged;

a secondary transfer device, for performing a secondary transfer stage, wherein a composite toner image on the endless intermediate transfer belt is transferred at a secondary transfer section where the endless intermediate transfer belt and a transfer material are oppositely arranged;

a bending member, for bending a toner image supporting surface of the endless intermediate transfer belt between the first transfer section and the secondary transfer section towards an inner surface side of the endless intermediate transfer belt;

a cleaning device, disposed between the bending member and the secondary transfer section, for cleaning up the toner image supporting surface of the endless intermediate transfer belt;

an opposite member, disposed at a position opposite to the cleaning device to sandwich the endless intermediate transfer belt, and in contact with the inner surface of the endless intermediate transfer belt;

wherein the bending member is a tension member for providing a tension against the endless intermediate transfer belt by a displacement of the bending member; and wherein in a status that a perimeter is minimum, the tension member has a maximum displacement to an outer surface side of the endless intermediate transfer belt, the endless intermediate transfer belt has the perimeter where a contact portion with respect to the opposite member is bent to the outer surface side.

5. A belt device, comprising:

an endless belt;

a driving roller for driving the endless belt to rotate in a predetermined direction;

a supporting roller, for supporting the belt at a position at a loose side of the belt;

a bending member, located at a downstream side of the supporting roller in the belt's rotational direction, for bending an outer surface of the belt to an inner surface side of the belt;

an acting member, disposed between the supporting roller and the bending member, maintaining a predetermined position relationship with respect to the outer surface of the belt to provide a predetermined action on the outer surface of the belt;

an opposite member, disposed at a position opposite to the acting member to sandwich the belt, and being in contact with the inner surface of the belt; and wherein the opposite member is in contact with inner surface of the belt, such that a winding angle of the belt with respect to the supporting roller is set at an angle capable of separating a sheet that is transported along the outer surface of the belt of the supporting roller's upstream side in the belt's rotational direction from the outer surface of the belt.

6. The belt device of claim 5, wherein the acting member is a cleaning device for cleaning the outer surface of the belt.

7. The belt device of claim 6, wherein the cleaning device is a fur brush that is able to rotate and is in contact with the outer surface of the belt.

8. The belt device of claim 6, wherein the cleaning device is a blade in contact with the outer surface of the belt.

9. The belt device of claim 5, wherein the bending member is a roller.

10. The belt device of claim 5, wherein the opposite member is a roller.

11. The belt device of claim 5, wherein the belt is a transferring/transporting belt, for transporting a recording medium having an image recorded thereon, and for transferring the image, which is formed on an image supporter disposed along the outer surface of the belt, onto the recording medium.

12. The belt device of claim 5, wherein the belt is an intermediate transfer belt, wherein an image on an image supporter disposed along the outer surface of the belt is first transferred, and the first transferred image is second transferred on a recording medium that is fed to opposite the outer surface of the belt.

13. A belt device, comprising:

an endless belt;

a driving roller for driving the endless belt to rotate in a predetermined direction;

a supporting roller, for supporting the belt at a position of a loose side of the belt;

a bending member, located at a downstream side of the supporting roller in the belt's rotational direction, for bending an outer surface of the belt to an inner surface side of the belt;

an acting member, disposed between the supporting roller and the bending member, maintaining a predetermined position relationship with respect to the outer surface of the belt to provide a predetermined action on the outer surface of the belt;

an opposite member, disposed at a position opposite to the acting member to sandwich the belt, and being in contact with the inner surface of the belt; and a belt tension applying member for providing a predetermined tension against the belt, wherein the belt tension applying member is disposed at a position where a winding angle of the belt with respect to the supporting roller is not changed by utilizing a displacement of the belt tension applying member.

14. The belt device of claim 13, wherein the bending member also functions as the belt tension applying member.

15. The belt device of claim 14, wherein the opposite member is disposed at a position to press the inner surface of the belt, even though the belt has a maximum contraction and the bending member displaces to the outer surface side of the belt.

16. The belt device of claim 13, wherein the belt tension applying member is a roller.

17. The belt device of claim 13, wherein the belt, the driving roller, the supporting roller, the bending member, and the belt tension applying member are integrally contained within a frame, wherein the frame is detachably installed at a predetermined position in an image forming device that is used to form an image on a recording medium.

18. The belt device of claim 17, further comprising a driving force transmitting device for transmitting a driving force from a driving source installed in a main body of the image forming device to the driving roller, as the frame is installed at the predetermined position in the image forming device.

19. An image forming device, comprising at least one image supporter, for supporting an image;

at least one image forming means, for forming the image on the image supporter; and a transferring device, and wherein the transferring device further comprises an endless belt;

a driving roller for driving the endless belt to rotate in a predetermined direction;

a supporting roller, for supporting the belt at a position at a loose side of the belt;

a bending member, located at a downstream side of the supporting roller in the belt's rotational direction, for bending an outer surface of the belt to an inner surface side of the belt;

an acting member, disposed between the supporting roller and the bending member, maintaining a predetermined position relationship with respect to the outer surface of the belt to provide a predetermined action on the outer surface of the belt;

an opposite member, disposed at a position opposite to the acting member to sandwich the belt, and being in contact with the inner surface of the belt; and wherein the opposite member is in contact with inner surface of the belt, such that a winding angle of the belt with respect to the supporting roller is set an angle capable of separating a sheet that is transported along the outer surface of the belt of the supporting roller's upstream side in the belt's rotational direction from the outer surface of the belt.

20. The image forming device of claim 19, wherein the acting member is a cleaning device for cleaning the outer surface of the belt, a blade in contact with the outer surface of the belt, or a fur brush that is able to rotate and is in contact with the outer surface of the belt.

21. The image forming device of claim 19, wherein the belt is a transferring/transporting belt, for transporting a recording medium having an image recorded thereon, and for transferring the image, which is formed on an image supporter disposed along the outer surface of the belt, onto the recording medium.

22. The image forming device of claim 19, wherein the belt is an intermediate transfer belt, wherein the image on the image supporter disposed along the outer surface of the belt is first transferred, and the first transferred image is second transferred on the recording medium that is fed to opposite the outer surface of the belt.

23. The image forming device of claim 19, wherein the image forming device further comprises a plurality of developing devices capable of sequentially overlapping toner images with different colors onto the endless belt.

24. The image forming device of claim 19, wherein the image supporter and the image forming means forms one image forming unit, and a plurality of the image forming units are arranged along the endless belt.

25. An image forming device, comprising at least one image supporter, for supporting an image;

at least one image forming means, for forming the image on the image supporter; and a transferring device, and wherein the transferring device further comprises an endless belt;

a driving roller for driving the endless belt to rotate in a predetermined direction;

a supporting roller, for supporting the belt at a position at a loose side of the belt;

a bending member, located at a downstream side of the supporting roller in the belt's rotational direction, for bending an outer surface of the belt to an inner surface side of the belt;

an acting member, disposed between the supporting roller and the bending member, maintaining a predetermined position relationship with respect to the outer surface of the belt to provide a predetermined action on the outer surface of the belt;

an opposite member, disposed at a position opposite to the acting member to sandwich the belt, and being in contact with the inner surface of the belt; and a belt tension applying member for providing a predetermined tension against the belt, wherein the belt tension applying member is disposed at a position where a winding angle of the belt with respect to the supporting roller is not changed by utilizing a displacement of the belt tension applying member.

26. The image forming device of claim 25, wherein the bending member also functions as the belt tension applying member.

27. The image forming device of claim 26, wherein the opposite member is disposed at a position to press the inner surface of the belt, even though the belt has a maximum contraction and the bending member displaces to the outer surface side of the belt.

28. The image forming device of claim 25, wherein the bending member, the opposite member, and the belt tension applying member are rollers.

29. The image forming device of claim 25, wherein the belt, the driving roller, the supporting roller, the bending member, and the belt tension applying member are integrally contained within a frame, wherein the frame is detachably installed at a predetermined position in an image forming device that is used to form an image on a recording medium.

30. The image forming device of claim 29, further comprising a driving force transmitting device for transmitting a driving force from a driving source installed in a main body of the image forming device to the driving roller, as the frame is installed at the predetermined position in the image forming device.

* * * * *